US008559840B2

(12) United States Patent
Furukawa

(10) Patent No.: US 8,559,840 B2
(45) Date of Patent: Oct. 15, 2013

(54) IMAGE REMOVAL FROM A BELT OF AN IMAGE FORMING APPARATUS

(75) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 133 days.

(21) Appl. No.: 13/238,090

(22) Filed: Sep. 21, 2011

(65) Prior Publication Data

US 2012/0076524 A1 Mar. 29, 2012

(30) Foreign Application Priority Data

Sep. 28, 2010 (JP) ..... 2010-216672

(51) Int. Cl.
*G03G 15/01* (2006.01)
*G03G 15/16* (2006.01)
*G03G 21/00* (2006.01)

(52) U.S. Cl.
USPC ..... 399/72; 399/71; 399/101

(58) Field of Classification Search
USPC ..... 399/71, 72, 101, 343
See application file for complete search history.

(56) References Cited

U.S. PATENT DOCUMENTS

2012/0008973 A1* 1/2012 Sakakibara et al. ..... 399/71

FOREIGN PATENT DOCUMENTS

| | | |
|---|---|---|
| JP | 58-058561 | 4/1983 |
| JP | 06-186886 | 7/1994 |
| JP | 09-305084 | 11/1997 |
| JP | 11-119478 | 4/1999 |
| JP | 2001-034139 | 2/2001 |
| JP | 2005-084543 | 3/2005 |
| JP | 2007-206520 | 8/2007 |
| JP | 2008-058564 | 3/2008 |
| JP | 2009-265543 | 11/2009 |
| JP | 2010-107797 | 5/2010 |

OTHER PUBLICATIONS

Notification of Decision to Grant issued in corresponding Japanese Patent Application No. 2010-216672 dated Sep. 18, 2012.

* cited by examiner

*Primary Examiner* — Sophia S Chen
(74) *Attorney, Agent, or Firm* — Banner & Witcoff, Ltd.

(57) ABSTRACT

An image forming apparatus includes: an image carrier rotates in a predetermined direction; a correction image forming unit forming correction images on the image carrier in the predetermined direction; and a cleaning roller configured to clean the correction images on the image carrier. With respect to all values ranging from 1 to an arbitrary value n, a positive integer N which satisfies following expression for each of n exists: $(T\times N+L)/n \leq R/V \leq (T\times(N+1)-L)/n$, where R represents a circumferential length of the cleaning roller, L represents a length of each of the correction images in a moving direction of the image carrier, T represents a formation interval of the correction images in the moving direction of the image carrier, and V represents a ratio of a peripheral speed of the cleaning roller to a moving speed of the image carrier.

6 Claims, 9 Drawing Sheets

IMAGE REMOVAL FROM A BELT OF AN IMAGE FORMING APPARATUS

This application is based upon and claims the benefit of priority of Japanese Patent Application No. 2010-216672 filed on Sep. 28, 2010, the contents of which are incorporated herein by reference in its entirety.

BACKGROUND

The present disclosure relates to an image forming apparatus.

In an electrophotographic color image forming apparatus, a color image is formed by superimposing and transferring images of respective colors on a recording medium placed on a conveying belt or an intermediate transfer belt.

If the image forming position (registration) of each color with respect to the recording medium or the intermediate transfer belt is misaligned and the images of the colors hence cannot be correctly superimposed and transferred, a good color image cannot be formed.

For example, in a direct tandem type image forming apparatus, a sensor is disposed at a position which is opposed to a recording medium conveying surface of the conveying belt. A registration correction image is formed on the conveying belt, and the sensor reads the registration correction image to detect misalignment of the registration. Then, the timing of exposure on the surface of a photosensitive member by an exposing device is adjusted, thereby preventing misalignment of the registration from occurring.

Further, in order to prevent the density of a toner image from being changed due to the aging of the apparatus, a change in the environment, or the like, a density correction image is formed on the conveying belt, and the density of the density correction image is detected by a sensor, thereby controlling the image density.

The above-described correction images are removed from the conveying belt by a cleaning unit which is opposed to the recording medium conveying surface of the conveying belt.

As such a cleaning unit, a unit having a cleaning roller which is placed so as to butt against a conveying belt is known. In a portion where the cleaning roller butts against the conveying belt, the cleaning roller rotates in the direction opposite to the moving direction of the conveying belt, and removes a correction pattern on the conveying belt.

SUMMARY

In the related method in which a correction pattern on a conveying belt is removed by a cleaning roller, there is a case where, at each rotation of the cleaning roller, the correction image is removed by the same portion of the cleaning roller. Consequently, there is a problem in that the cleaning roller cannot effectively remove the correction image on the conveying belt.

In view of the problem, it is an object of an aspect of the disclosure to provide an image forming apparatus in which a correction pattern can be satisfactorily recovered by a cleaning roller.

An image forming apparatus comprising:

an image carrier configured to rotate in a predetermined direction;

a correction image forming unit configured to form a plurality of correction images for correcting image forming conditions, on the image carrier in the predetermined direction; and a cleaning roller configured to clean the correction images on the image carrier, and wherein, with respect to all values ranging from 1 to an arbitrary value n, a positive integer N which satisfies following expression for each of n exists:

$$(T\times N+L)/n\leq R/V\leq(T\times(N+1)-L)/n$$

where R represents a circumferential length of the cleaning roller, L represents a length of each of the correction images in a moving direction of the image carrier, T represents a formation interval of the correction images in the moving direction of the image carrier, V represents a ratio of a peripheral speed of the cleaning roller to a moving speed of the image carrier, and n is a positive integer.

DESCRIPTION OF EXEMPLARY EMBODIMENTS

1. Entire Configuration of Printer

Figure 1:
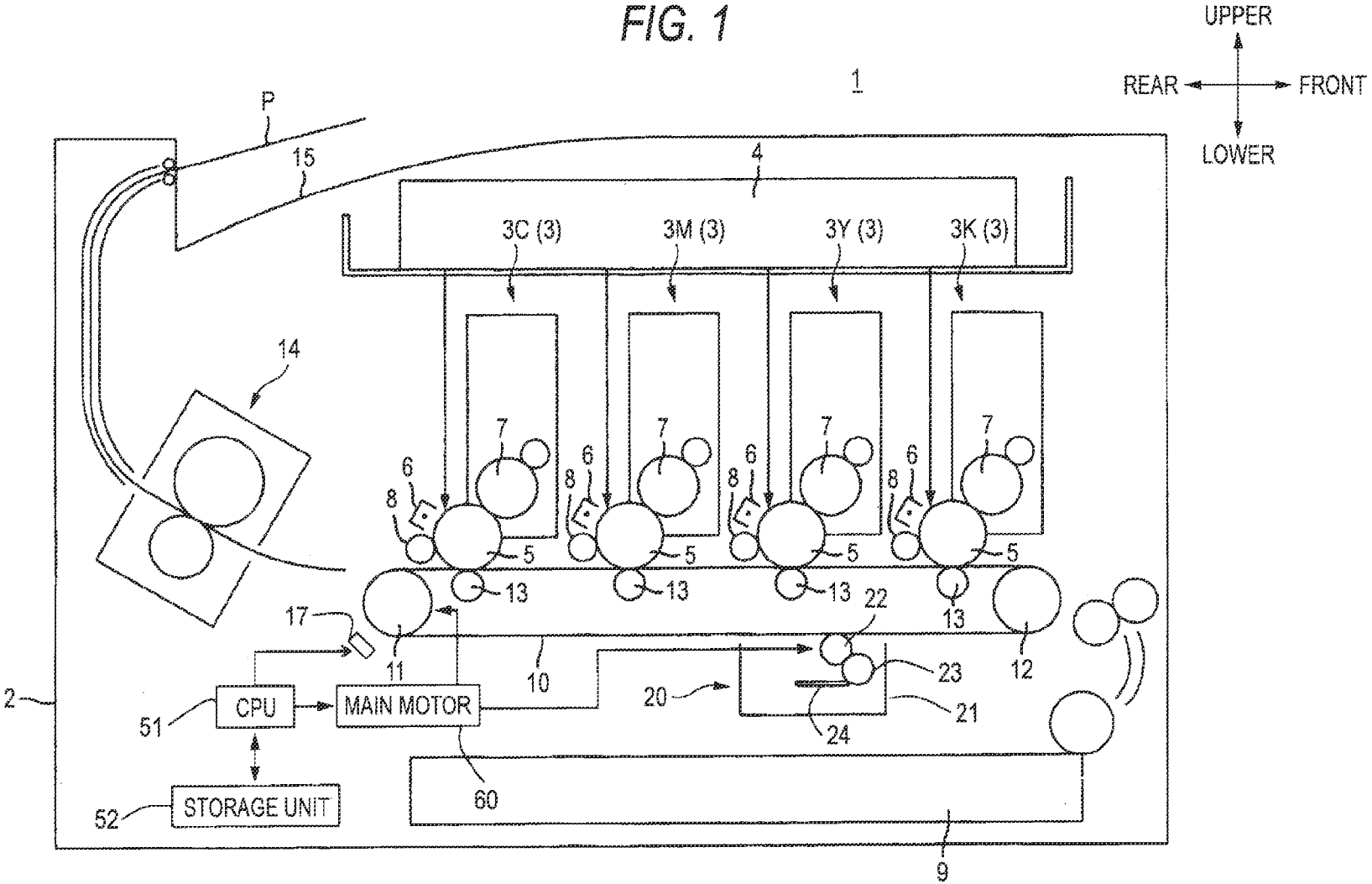
FIG. 1 is a side sectional view of a color laser printer.

FIG. 1 is a side sectional view of a color laser printer which is one example of the image forming apparatus according to the exemplary embodiment. Hereinafter, an embodiment will be described with using the directions (upper, lower, front, and rear) which are defined in the figure.

The color laser printer 1 is a tandem type color laser printer. Four process portions 3 are placed in parallel in a body casing 2. The process portions 3 are disposed correspondingly with colors of black, yellow, magenta, and cyan, and arranged in the sequence of black, yellow, magenta, and cyan in the conveying direction (anteroposterior direction) of a sheet P by a conveying belt 10 which will be described later. An exposing device 4 which emits four laser beams respectively corresponding to the colors is placed above the process portions 3.

In FIG. 1, with the respective process portions 3 of the colors, characters of K (black), Y (yellow), M (magenta), and C (cyan) which indicate the respective colors are affixed to the ends of their reference numerals, respectively.

Each of the process portions 3 includes a photosensitive drum 5, a Scorotron charging device 6, a developing roller 7, and a drum cleaning roller 8. In accordance with rotation of the photosensitive drum 5, the surface of the photosensitive drum 5 is uniformly charged by the Scorotron charging device 6, and then selectively exposed by the laser beam emitted from the exposing device 4. This exposure causes charges on the surface of the photosensitive drum 5 to be selectively removed therefrom, and an electrostatic latent image is formed on the surface of the photosensitive drum 5. A developing bias is applied to the developing roller 7. When the electrostatic latent image is opposed to the developing roller 7, a toner is supplied from the developing roller 7 to the electrostatic latent image by the potential difference between the electrostatic latent image and the developing roller 7. As a result, a toner image is formed on the surface of the photosensitive drum 5.

In place of the exposing device 4, four LED arrays may be disposed correspondingly with each of the process portions 3.

A sheet supply cassette 9 which houses sheets P is placed in a bottom portion of the body casing 2. The sheets P housed in the sheet supply cassette 9 are conveyed onto the conveying belt 10 which is an example of an image carrier, by various rollers. The conveying belt 10 is stretched between a pair of a driving roller 11 and a driven roller 12, and placed so as to be opposed to the four photosensitive drums 5 from the lower side. Transfer rollers 13 are placed at positions which are opposed to the photosensitive drums 5 across an upper side portion of the conveying belt 10, respectively. When the conveying belt 10 runs, the sheet P which is conveyed onto the conveying belt 10 is sequentially passed between the conveying belt 10 and the photosensitive drums 5. The toner image on the surface of each of the photosensitive drums 5 is transferred to the sheet P when the toner image is opposed to the sheet P, by a transferring bias applied to the corresponding transfer roller 13.

A fixing device 14 is disposed downstream of the conveying belt 10 in the conveying direction of the sheet P. The sheet P onto which toner images have been transferred is conveyed to the fixing device 14. In the fixing device 14, the toner images are fixed to the sheet P by heat and pressure. The sheet P onto which the toner images have been fixed is discharged to a sheet discharge tray 15 on the upper surface of the body casing 2 by various rollers.

A belt cleaner 20 is disposed between the sheet supply cassette 9 and the conveying belt 10. The bell cleaner 20 includes a flat box-like case 21. As shown in FIG. 1, a cleaning roller 22 having a circumferential length of R, and a recovery roller 23 which is an example of a secondary cleaning member are disposed in the front side of the case 21 so as to be rotatable in a state where the rollers are in pressing contact with each other. In the cleaning roller 22, a foamed member which is made of silicon rubber is disposed in the circumference of a metallic shaft member. The cleaning roller 22 is driven by a driving force of a main motor 60 which is disposed in the body casing 2, and which will be described later. A predetermined bias is applied to the cleaning roller 22, so that a toner and paper dusts adhering to the surface of the conveying belt 10 are removed from the conveying belt 10.

The recovery roller 23 is made of a metal, and a predetermined bias is applied between the roller and the cleaning roller 22, thereby attracting a toner and the like adhering to the surface of the cleaning roller 22. A rubber-made scraping blade 24 is in pressing contact with the lower side of the recovery roller 23, so that a toner and the like adhering to the surface of the recovery roller 23 are scraped off to be recovered into the case 21.

A toner which remains on the surface of the photosensitive drum 5 after transfer of a toner image to the sheet P are removed from the surface of the photosensitive drum 5 by the drum cleaning roller 8.

In the color laser printer 1, as shown in FIG. 1, an optical sensor 17 is placed below the rear side of the conveying belt 10. The optical sensor 17 is a reflection type sensor including a light emitting portion and a light receiving portion.

(Electric Configuration of Color Laser Printer)

Next, the electric configuration of the color laser printer 1 will be described.

As shown in FIG. 1, the color laser printer 1 has a CPU 51 and a storage unit 52.

The CPU 51 controls various components in accordance with programs stored in the storage unit 52. For example, the CPU 51 drives the main motor 60 which is disposed in the body casing 2, to rotationally drive the conveying belt 10 and the cleaning roller 22.

The storage unit 52 stores programs and the like for controlling the color laser printer 1. The storage unit 52 which will be described later previously stores a ratio V of the peripheral speed of the cleaning roller 22 to the moving speed of the conveying belt 10, the circumferential length R of the cleaning roller 22, a patch length L which is an example of the length of a correction image, and a patch formation period T which is an example of a formation interval of the correction images.

The CPU 51 causes the cleaning roller 22 and the conveying belt 10 to be rotated by the main motor 60 so that the ratio of the peripheral speed of the cleaning roller 22 to the moving speed of the conveying belt 10 has a predetermined value V.

The CPU 51 forms the correction images for correcting various image forming conditions, at a predetermined timing on the conveying belt 10. For example, the predetermined timing is a timing when the time elapsed from the former formation of the correction images, or the number of sheets P on which an image is formed reaches a certain reference value.

Figure 2:
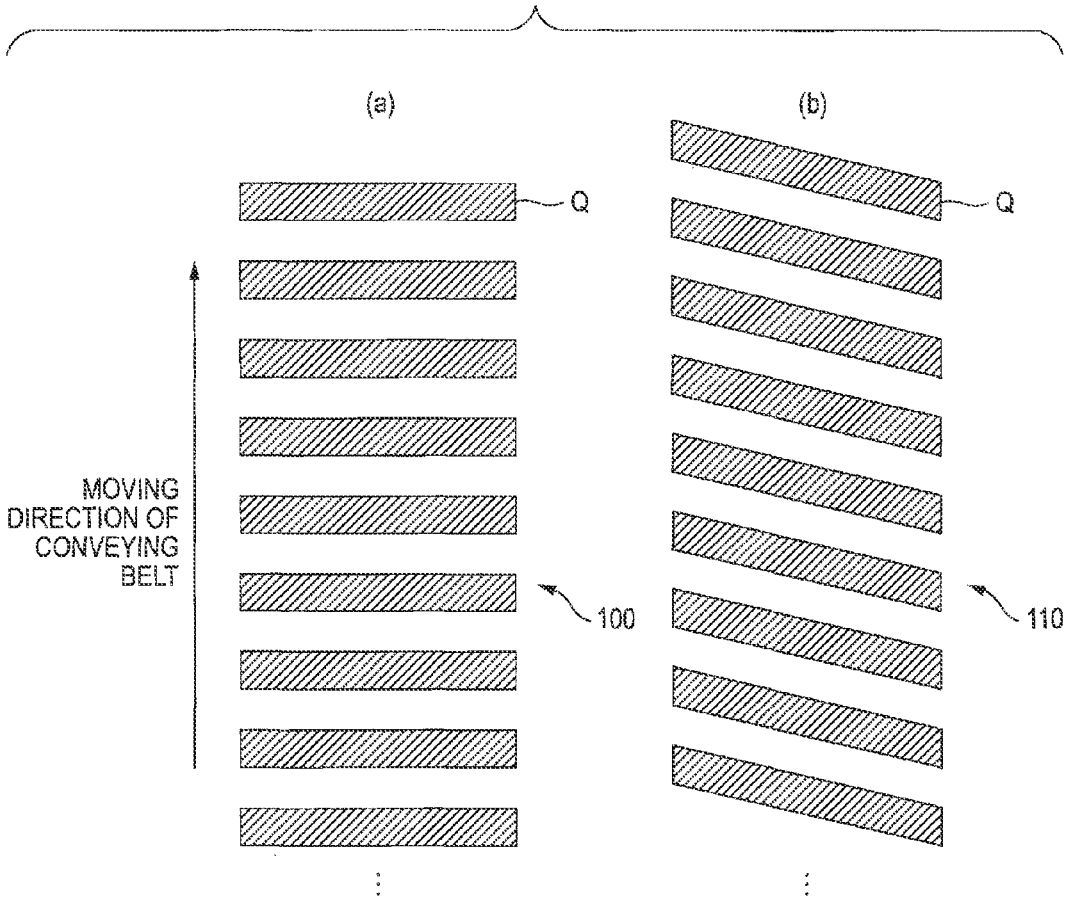
FIG. 2 is a view showing a first pattern (a) and a second pattern (b).

As shown in (a) and (b) of FIG. 2, for example, the CPU 51 forms a first pattern 100 and a second pattern 110 on the conveying belt 10 in order to correct the image forming position. The first pattern 100 and the second pattern 110 are formed at the above-described timing by the process portions 3.

The first pattern 100 is used for detecting a misalignment of the image forming position in the moving direction of the conveying belt 10. Specifically, the first pattern 100 is formed by a plurality of bar-like patches Q of the colors which extend in a lateral direction. The patches Q are formed so as to have a predetermined length in the moving direction (rotation direction) of the conveying belt 10. Furthermore, the patches Q are regularly formed so that the distance of adjacent patches Q coincides with a predetermined interval (period) in the moving direction of the conveying belt 10.

The second pattern 110 is used for detecting a misalignment of the image forming position in a direction (the lateral direction which is perpendicular to the sheet surface in FIG. 1) perpendicular to the moving direction of the conveying belt 10. Specifically, the second pattern 110 is formed by a plurality of bar-like patches Q which are angled with respect to the moving direction of the conveying belt 10.

The patches Q of the second pattern 110 are regularly formed so that, similarly with the first pattern 100, the distance of adjacent patches Q coincides with a predetermined period in the moving direction of the conveying belt 10.

The optical sensor 17 detects the first pattern 100 and second pattern 110 which are formed on the conveying belt 10. From a result of the detection, the CPU 51 derives the degree of the misalignments of the image forming positions of the colors with respect to an ideal position, and adjusts the exposure positions of the laser beams which are an example of image forming conditions, by using a well-known method.

(Detailed Description of Formation of Patches and their Cleaning)

Figure 3:
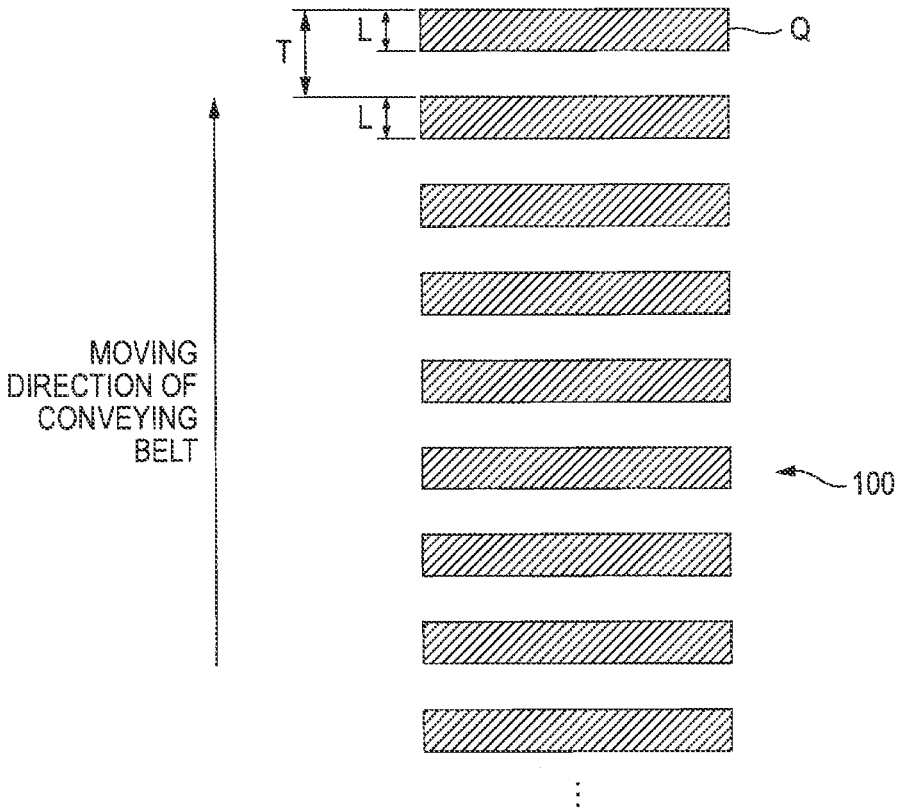
FIG. 3 is a view showing a patch length L and a patch formation period T in the first pattern.

Referring to FIG. 3, next, a method of forming the patches Q on the conveying belt 10, and removal of the patches Q by the cleaning roller 22 will be described. In the following, the embodiment will be described by using the first pattern 100. The second pattern 110 is formed based on the same concept as the first pattern 100, and hence its description will be omitted.

The CPU 51 forms the patches Q along the moving direction of the conveying 10. Furthermore, the CPU 51 forms the patches Q on the conveying belt 10 so as to be at a substantially identical position in the direction of the rotation axis of the cleaning roller 22. In the embodiment, the patches Q are formed in an end side portion on the conveying belt 10 in the direction of the rotation axis of the cleaning roller 22.

The plurality of patches Q formed by the CPU 51 have the predetermined length L and the predetermined period T in the moving direction of the conveying belt 10. In FIG. 3, the patch formation period T means the distance extending from the downstream end portion of an interested patch Q in the moving direction of the conveying belt 10 to the downstream end portion of a patch Q which is adjacent to the interested patch Q, in the moving direction of the conveying belt 10.

In the case where the circumferential length of the cleaning roller 22 is R, the length L of the patches Q, the formation period T of the patches Q, and the ratio V of the peripheral speed of the cleaning roller 22 to the moving speed of the conveying belt 10 satisfy the following relational expression in which n and N are natural numbers:

$$(T\times N+L)/n\leq R/V\leq(T\times(N+1)-L)/n \qquad \text{Exp. (1)}$$

In Exp. (1), the units of T, L, and R are length units.

(Description of Basic Concept of the Embodiment)

Appropriately referring to the figures, the basic concept of the embodiment will be described by using Exp. (1).

Figure 4:
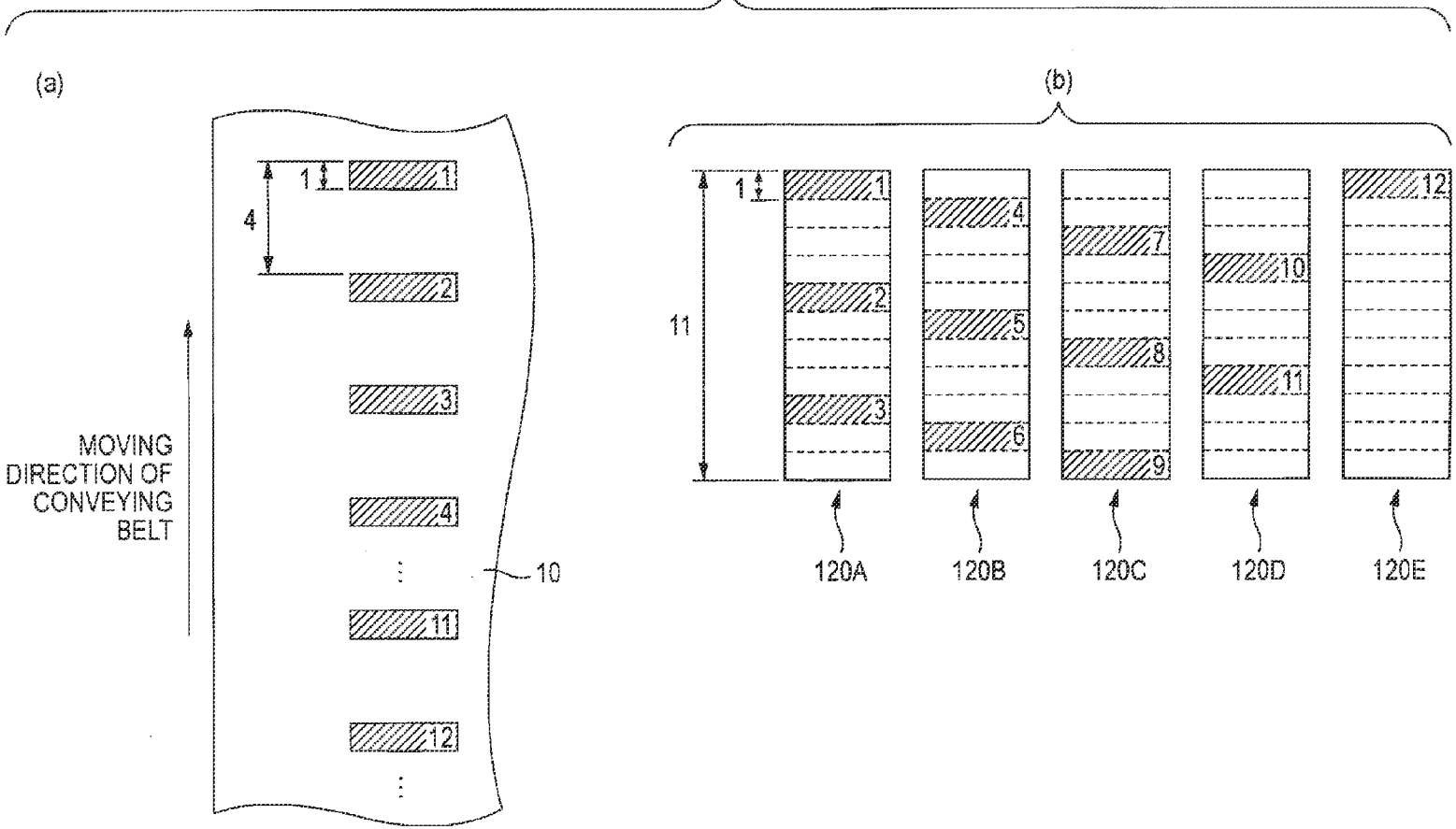
FIG. 4 shows a view (a) showing the first pattern which is formed by the predetermined patch length L and patch formation period T, and a view (b) showing positional relationships of patches Q which are attracted onto a cleaning roller 22 during each of first to fifth rotations of the cleaning roller, respectively.

(a) of FIG. 4 shows the patches Q formed on the conveying belt 10. (b) of FIG. 4 is a conceptual view showing positional relationships of the patches Q which are moved onto the cleaning roller 22. In FIG. 4A, the conveying belt 10 is moved from the lower side of the sheet surface to the upper side.

As shown in (a) of FIG. 4, the patches Q are formed on the conveying belt 10 so as to have the predetermined patch length L and patch formation period T. Specifically, the patches Q are formed in the moving direction of the conveying belt 10 so that, in the case where the patch length L is 1, the patch formation period T is 4.

The numbers shown in the patches Q indicate the order counted from the patch Q which is located at the extreme downstream end in the first pattern 100 in the moving direction of the conveying belt 10. In other words, the numbers shown in the patches Q indicate the order in which the patches are removed from the conveying belt 10 by the cleaning roller 22.

One rectangle 120 shown in (b) of FIG. 4 diagrammatically shows the development of the surface of the cleaning roller 22. As shown in (b) of FIG. 4, the length in the longitudinal direction of one rectangle 120 has a value which is obtained by dividing the circumferential length R of the cleaning roller 22 by the ratio V of the peripheral speed of the cleaning roller 22 to the moving speed of the conveying belt 10, i.e., R/V in Exp. (1). Namely, the length in the longitudinal direction of one rectangle 120 indicates the length of movement of the conveying belt 10 during a period when the cleaning roller 22 makes one rotation.

In each rectangle 120, the length in the longitudinal direction is equally divided by broken lines, and the rectangle is partitioned into a plurality of cells. The length in the longitudinal direction of one cell corresponds to the length L=1 of the patches Q. The cleaning of the patches Q in the case of R/V=11 will be described with reference to (b) of FIG. 4.

In FIG. (b) of 4, five rectangles 120A to 120E which are defined as described above are shown. Each rectangle 120 has a colored cell(s). Each colored cell indicates a place where a patch Q is attracted.

The rectangles 120A to 120E diagrammatically show places in which the patches Q are attracted onto the cleaning roller 22 in rotations (first to fifth rotations) of the cleaning roller 22, in this sequence.

Specifically, the rectangle 120A indicates positional relationships of patches Q which are attracted onto the cleaning roller 22 during a period from the timing when the initial patch Q of the first pattern 100 shown in (a) of FIG. 4 is attracted, to that when the roller makes one rotation. During a period when the cleaning roller 22 makes one rotation, the roller attracts the first to third patches Q.

The rectangle 120B shows positional relationships of patches Q which are attracted during a period of the second rotation of the cleaning roller 22, on the surface of the cleaning roller 22. During the second rotation, the cleaning roller 22 attracts the fourth to sixth patches Q. The fourth to sixth patches Q are attracted to places which are adjacent to the places where the patches Q are attracted to the cleaning roller 22 during the first rotation, respectively.

Similarly, the rectangle 120C shows positional relationships of patches Q which are attracted during a period of the third rotation of the cleaning roller 22. During the third rotation of the cleaning roller 22, the seventh to ninth patches Q are attracted onto the cleaning roller 22. The patches Q which are attracted during the third rotation are attracted to places which are adjacent to the places where the patches Q are attracted to the cleaning roller 22 during the previous rotation and the patches Q are not attracted during and before the previous rotation.

When the cleaning roller 22 starts to make the fourth rotation, the tenth patch Q is attracted between the seventh and second patches Q, and the eleventh patch Q is attracted between the eighth and third patches Q. The patch Q which is recovered in the twelfth recovery is recovered in the place on the cleaning roller 22 which is identical with the place of the first patch Q in the first rotation. During the fifth rotation, namely, the cleaning roller 22 attracts the patch Q in the place which overlaps with that where the patch Q is attracted during the first rotation.

As described above, during the period from when the cleaning roller 22 attracts the first patch Q, to when the cleaning roller 22 starts to make the fifth rotation, the cleaning roller 22 attracts the patches Q on the conveying belt 10 in positions which are different from those where recovery is performed during the first to fourth rotations.

Figure 5:
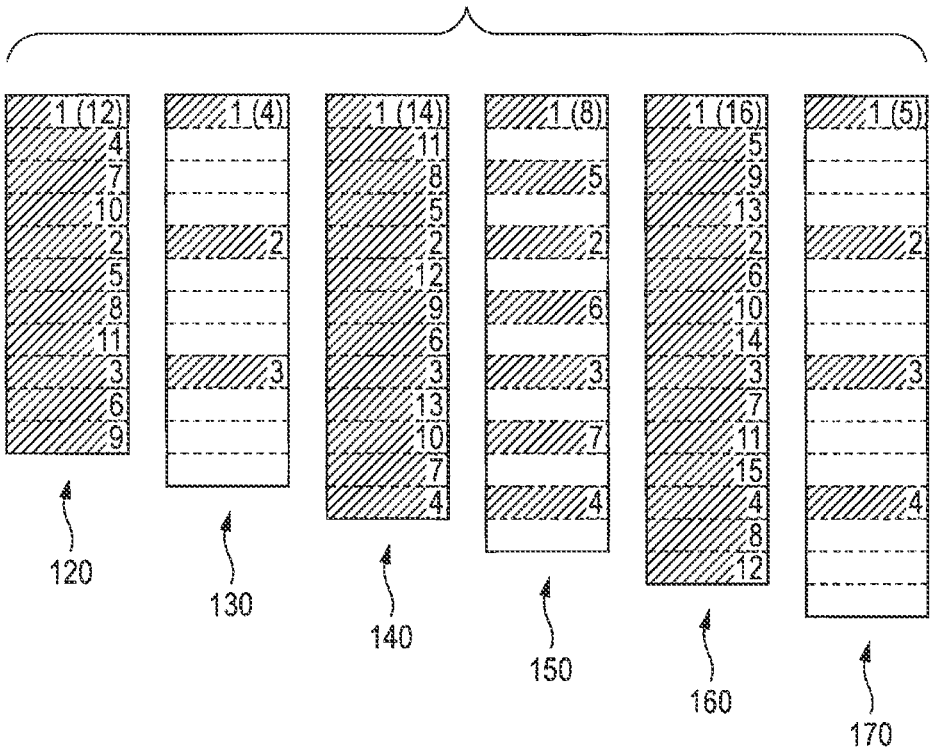
FIG. 5 is a view showing positional relationships of patches which are attracted onto the cleaning roller 22 while the patch length L and the patch formation period T are made constant, and the value of R/V is changed.

The rectangle 120 shown in FIG. 5 is obtained by overlapping the rectangles 120A to 120E shown in (b) of FIG. 4 with one another, and indicates the positional relationships of the patches Q which are attracted by one rectangle. FIG. 5 also shows rectangles 130 to 170 which are obtained in the case where the value of R/V is changed. The values of R/V in the rectangles 130 to 170 are 12, 13, 14, 15, and 16 in this sequence.

In the rectangles 130 to 170, the patch length L and the patch formation period T are fixed to L=1 and T=4, respectively. Similarly with the rectangle 120, each of the rectangles indicates positional relationships of patches Q which are attracted onto the cleaning roller 22.

In each of the rectangles 130 and 170 shown in FIG. 5, for example, the value of R/V is a multiple of the patch formation period T. Therefore, it is seen that, during the second rotation of the cleaning roller 22, the patch Q is subjected to cleaning in the place which overlaps with that on the cleaning roller 22 where the patch Q is attracted during the first rotation.

In the rectangle 150, the value of R/V is 14. In FIG. 5, the cleaning roller 22 attracts the first to fourth patches Q during the first rotation, attracts the fifth to seventh patches Q during the second rotation, and attracts the eighth patch Q which is attracted during the third rotation, in the place which is identical with that where the patch Q that is first attracted during the first rotation. Namely, the cleaning roller 22 attracts, during the third rotation, the patch Q for the first time in the place which overlaps with that where the patch Q is attracted during the first rotation.

The rectangles 140 and 160 attract the first to fourth patches Q during the first rotation. In the rectangle 140, the thirteenth patches Q are attracted during the third or previous rotation, and the fourteenth patch Q which is attracted during the fourth rotation overlaps for the first time with the place where the patch Q is first attracted.

Also in the rectangle 160, similarly, the cleaning roller 22 sequentially attracts the first to fifteenth patches Q during the first to third rotations, and the sixteenth patch Q which is attracted during the fourth rotation overlaps for the first time with the place where the patch Q is first attracted.

In the case where the patches Q are formed under the conditions indicated in the rectangles 120 to 170 of FIG. 5 and are subjected to cleaning by the cleaning roller 22, Exp. (1) is expressed as following Exp. (2) in the range of $11 \le R/V \le 16$.

$$(4\times N+1)/n \le R/V \le (4\times(N+1)-1)/n \qquad \text{Exp. (2)}$$

Here, n=1 is substituted into Exp. (2). At this time, Exp. (2) is $9 \le R/V \le 11$ in the case of N=2, $13 \le R/V \le 15$ in the case of N=3, and $17 \le R/V \le 19$ in the case of N=4. In FIG. 5, the value of R/V which satisfies the above includes 11, 13, 14, and 15.

This indicates that, in the rectangles 140 to 170, for example, the value of R/V may be in the range from the position where the fourth patch Q is formed, to that which is returned by the distance corresponding to the patch length L from the position where the fifth patch Q is formed. In other words, the value of R/V in the case of N=3 must be shorter at least by the patch length L than the value of T for four periods.

Therefore, at least the patches Q which are attracted during the second rotation of the cleaning roller 22 are attracted places between the patches Q which are attracted during the first rotation. In the (n+1)-th rotation, i.e., the second rotation of the cleaning roller 22, consequently, the patches Q are attracted in places which do not overlap with those where the patches Q are attracted during the first rotation.

Next, n=2 is substituted into Exp. (2). At this time, Exp. (2) is $10.5 \le R/V \le 11.5$ in the case of N=5, $12.5 \le R/V \le 13.5$ in the case of N=6, $14.5 \le R/V \le 15.5$ in the case of N=7, and $16.5 \le R/V \le 17.5$ in the case of N=8.

Then, the value of R/V is $10.5 \le R/V \le 11.5$ in the case of N=5. At this time, Exp. (2) satisfies R/V=10.5 which does not satisfy Exp. (3) in the case of n=1.

This is because Exp. (2) in the case of n=2 constitutes conditions for causing the cleaning roller 22 not to overlap with the patch Q which is first attracted in the third rotation. When R/V=14, the cleaning roller does not overlap with the first patch Q during the third rotation, but the patch Q is attracted at the position which overlaps with the first patch Q during the second rotation.

In order that, on the cleaning roller 22, the patch Q which is attracted during the third rotation does not overlap with the place where attraction is performed in the first rotation, therefore, it is necessary that R/V has a value which simultaneously satisfies Exp. (2) in the case of n=1, and that in the case of n=2. The value of R/V includes 11, 13, and 15.

In the case of R/V=11, 13, or 15, therefore, it is possible to prevent the place where the patch Q is attracted during the (n+1)-th rotation, i.e., the third rotation of the cleaning roller 22, from overlapping with that where the patch Q is attracted during the first rotation.

By contrast, when n=2 is substituted into Exp. (2), there is no value of N which satisfies R/V=14. In the case of R/V=14, therefore, the cleaning roller 22 attracts, during the third rotation, the patch Q for the first time in the place which overlaps with that where the patch Q is attracted during the first rotation. This is because, in the case of R/V=14, when the cleaning roller 22 makes two rotations, the amount of rotation of the cleaning roller 22 is an integral multiple of the patch formation period T.

Next, n=3 is substituted into Exp. (2). At this time, Exp. (2) is $11.0 \le R/V \le 11.7$ in the case of N=8, $12.3 \le R/V \le 13.0$ in the case of N=9, and $15.0 \le R/V \le 15.7$ in the case of N=11. When n=3, therefore, the value of N exists in each of the cases of R/V=11, 13, and 15. In the case of R/V=11, 13, or 15, therefore, it is possible to prevent the place where the patch Q is attracted during the (n+1)-th rotation, i.e., the fourth rotation of the cleaning roller 22, from overlapping with that where the patch Q is attracted during the first rotation.

Next, n=4 is substituted into Exp. (2). At this time, the cleaning roller makes four rotations, and the value of R/V is always a multiple of the patch formation period T. During the fifth rotation, therefore, the cleaning roller 22 attracts the patch Q for the first time in the place which overlaps with that where the patch Q is attracted during the first rotation.

Then, the cleaning of the patches Q by the cleaning roller will be described with reference to FIG. 6.

Figure 6:
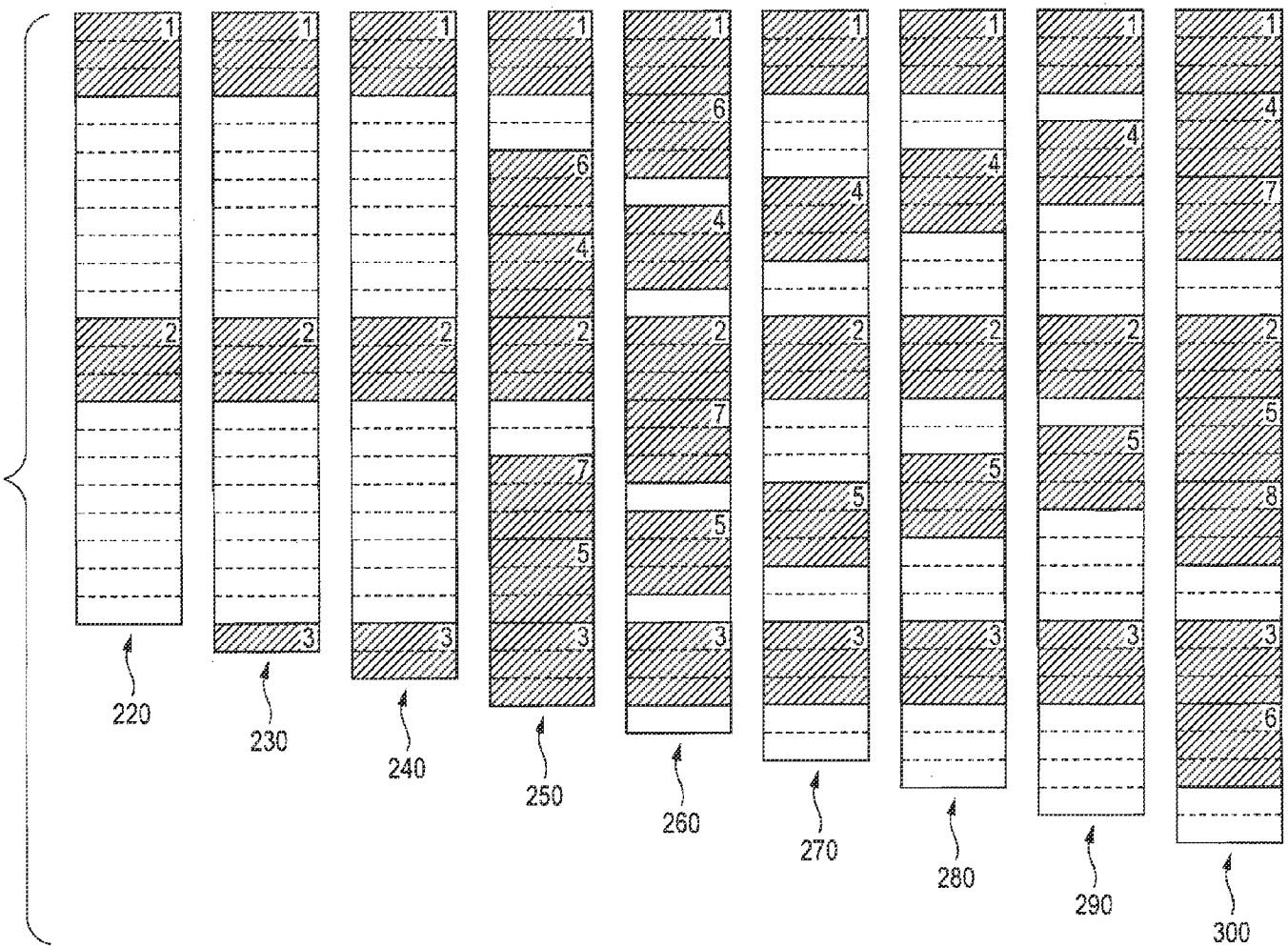
FIG. 6 is a view showing positional relationships of patches which are attracted onto the cleaning roller 22 while the patch length L and the patch formation period T are made constant, and the value of R/V is changed.

FIG. 6 is a view showing positional relationships of the patches Q which are attracted onto the cleaning roller 22 in the case where the patch length L and the patch formation period T are to L=3 and T=11, respectively. In FIG. 6, the patch length L corresponds to the length of three cells in the longitudinal direction.

The rectangles 220 to 300 shown in FIG. 6 have different values of R/V, or values of 22 to 30 in this sequence, respectively.

For example, in the rectangle 220, when R/V=22, the value is an integral multiple of the patch formation period T, and hence the cleaning roller 22 attracts the patches Q which are attracted during the second rotation, in places which overlap with those where attraction is performed during the first rotation.

In the rectangles 230 and 240, the patch Q which is third attracted cannot be sufficiently attracted during one rotation of the cleaning roller 22, and extends also in the place where the first attraction is performed during the second rotation.

In the rectangles 250 to 300, the patches Q are attracted in places which do not overlap with those where attraction is performed during the first rotation. Furthermore, it is seen that, as the value of R/V is further increased, the positions of the patches Q which are attracted during the second rotation and subsequent rotations are more shifted by the degree corresponding to the increased amount of R/V.

In the case where the patches Q are subjected to cleaning by the cleaning roller 22 under the conditions indicated in the rectangles 220 to 300 of FIG. 6, when 22≤R/V≤30, the following expression is held in Exp. (1):

$$(11\times N+3)/n \leq R/V \leq (11\times(N+1)-3)/n \quad \text{Exp. (3)}$$

Here, n=1 is substituted into Exp. (3). At this time, Exp. (3) is 25≤R/V≤30 in the case of N=2. In the rectangle 250, for example, the value of R/V is increased by the degree corresponding to the patch length L from the rectangle 220 where the value of R/V is an integral multiple of the patch formation period T. Therefore, the cleaning roller 22 can attract the patches Q in places which do not overlap with those where the patches Q are attracted during the first rotation.

The rectangles 230 to 300 are similarly configured, and the cleaning roller 22 can attract the patches Q in places which do not overlap with those where the patches Q are attracted during the first rotation.

Next, n=2 is substituted into Exp. (3). Then, the value of R/V is 23.5≤R/V≤26 in the case of N=4, and 29≤R/V≤31.5 in the case of N=5. At this time, Exp. (3) satisfies R/V=24 which does not satisfy Exp. (3) in the case of n=1.

This is because Exp. (2) in the case of n=2 constitutes conditions for causing the cleaning roller 22 not to overlap with the patch Q which is first attracted in the third rotation. When R/V=24, the cleaning roller does not overlap with the first patch Q during the third rotation, but the patch Q is attracted at the position which overlaps with the first patch Q during the second rotation.

In order that, on the cleaning roller 22, the patch Q which is attracted during the third rotation does not overlap with the place where attraction is performed in the first rotation, therefore, it is necessary that R/V has a value which simultaneously satisfies Exp. (2) in the case of n=1, and that in the case of n=2.

In the case of R/V=25, 26, 29, or 30, on the cleaning roller 22, the patch Q which is attracted during the third rotation does not overlap with the place where attraction is performed in the first and second rotations.

In the case of R/V=27 or 28, the cleaning roller 22 attracts, during the third rotation, the patch Q for the first time in the place which overlaps with the patch Q that is first attracted.

Furthermore, n=3 is substituted into Exp. (3). Then, the value of R/V is 24.6≤R/V≤26.7 in the case of N=7, and 28.3≤R/V≤30.3 in the case of N=8. When n=3, therefore, there is no value of R/V which satisfies conditions of n=1 and n=2 and further satisfies Exp. (6) also in the case of n=3. Also in the case of R/V=25, 26, 29, or 30, the cleaning roller 22 attracts, during the fourth rotation, the patch Q in the place which overlaps with that where the patch Q is attracted in the first rotation.

From FIGS. 5 and 6, it is seen that, in order that, during the (n+1)-th rotation, the patch Q does not overlap with the places where attraction is performed in the n-th and previous rotations, n+1<T/L must be satisfied. In order that, in Exp. (1), N which satisfies all values of n ranging from 1 to an arbitrary value exists, namely, n+1<T/L must be satisfied.

As described above, when the length L of the patch Q, the patch formation period T, the circumferential length R of the cleaning roller 22, and the ratio V of the peripheral speed of the cleaning roller 22, to the moving speed of the conveying belt 10 are determined so as to satisfy Exp. (1), the cleaning roller 22 makes at least (n+1) rotations before the patch Q is next attracted in the place of the surface of the cleaning roller 22 in which the interested patch Q is attracted. Therefore, a situation where, at each rotation, the correction image is removed by the same portion on the surface of the cleaning roller 22 can be prevented from occurring, and effective cleaning is enabled.

Since the recovery roller 23 is disposed, the recovery roller 23 can clean (n+1) times the place on the cleaning roller 22 in which the patch Q is attracted, before the patch Q is next attracted.

Therefore, the place on the cleaning roller 22 in which the patch Q is attracted is sufficiently cleaned before the patch Q is next attracted. Consequently, the cleaning roller 22 can satisfactorily remove the patches Q on the conveying belt 10.

In the above-described model, in order to allow the patches Q formed on the conveying belt 10 to be attracted onto the cleaning roller 22 in ideal positional relationships, the patch Q must be completely attracted at one point of the contacting portion of the cleaning roller 22 and the conveying belt 10.

In practice, the moving speed of the conveying belt 10 and the peripheral speed of the cleaning roller 22 are different from each other. In the case where the cleaning roller 22 and the conveying belt 10 are rotated in opposite directions at the contacting position as in the embodiment, particularly, there may occur a situation where a toner is dragged in the contacting portion. Therefore, it is contemplated that the length L of the patch Q which is actually attracted onto the cleaning roller 22 may be slightly longer than the length L of the patch Q which is formed on the conveying belt 10.

Therefore, it is contemplated that, in (b) of FIG. 4, for example, the patches Q (first to third) which are attracted during the first rotation of the cleaning roller 22 are attracted while being slightly protruded into the adjacent cells.

However, the length L of the patch Q attracted onto the cleaning roller 22 is large, and hence the toner amount of the patch Q which is attracted while being protruded into the adjacent cell is very small. Therefore, the toner due to the patch Q which is attracted while being protruded into the adjacent cell is recovered by the recovery roller 23 before the cleaning roller 22 starts the second rotation. Even when the place where the patch Q is attracted in the second rotation is adjacent to that where attraction is performed in the first rotation, therefore, the cleaning roller 22 can remove the patch Q from the conveying belt 10.

(Description of Specific Examples)

Next, specific examples will be described appropriately referring to the figures. In the following examples, the circumferential length R of the cleaning roller 22 is 47.12 mm.

Figure 7:
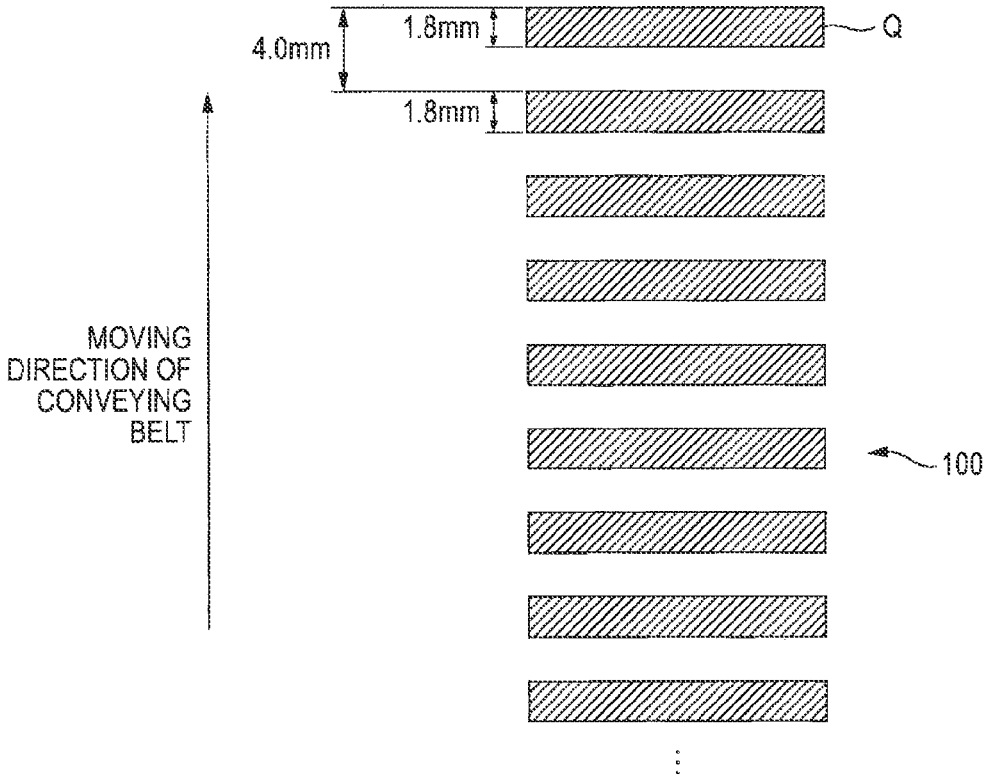
FIG. 7 is a view showing the first pattern in an example (first example).

FIG. 7 shows the first pattern 100 which is formed on the conveying belt 10 by a plurality of patches Q.

As shown in FIG. 7, the first pattern 100 is formed on the conveying belt 10 so that the length L of the patches Q is 1.80 mm, and the patch formation period T is 4.00 mm. The ratio of the peripheral speed of the cleaning roller 22 to the moving speed of the conveying belt 10 is controlled by the CPU 51 so as to be 1.57. At this time, the value of R/V is 30.0.

When the above values are substituted into Exp. (1), the following is attained:

$$(4\times N+1.8)/n \leq 30.0 \leq (4\times(N+1)-1.8)/n \quad \text{Exp. (4)}$$

In the case of n=1, when N=7, Exp. (4) is indicated as 29.8≤30.0≤30.2, and satisfied. In the ease of n=2, similarly, when N=14, the right side of Exp. (4) is 29.1, when N=15, the left side of Exp. (4) is 30.9, and hence there is no value of N which satisfies Exp. (4). This is seen also from that T/L=2.22.

Therefore, the only one value of to which satisfies Exp. (4) under the conditions shown in FIG. 7 is 1. During the (n+1)-th rotation, i.e., the second rotation, the cleaning roller 22 can attract the patch Q in the place which does not overlap with that where the patch Q is first attracted.

In the third rotation, then, the cleaning roller 22 overlaps with the place of the cleaning roller 22 in which the first patch Q is attracted, and performs attraction.

Figure 8:
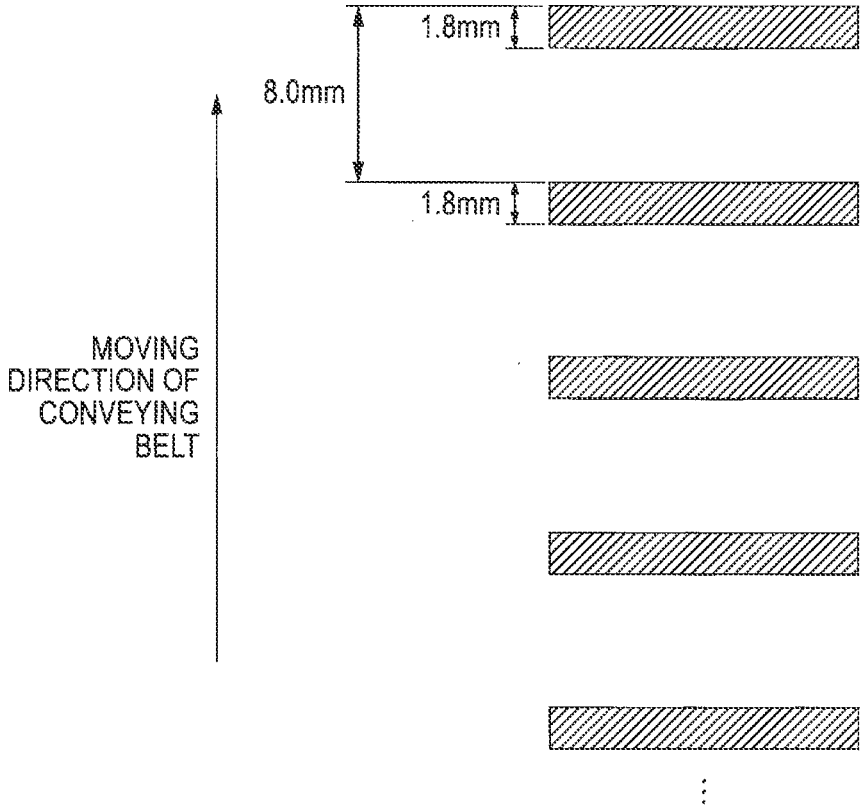
FIG. 8 is a view showing the first pattern in an example (second example).

FIG. 8 shows the first pattern 100 which is formed on the conveying belt 10 by a plurality of patches Q.

As shown in FIG. 8, the first pattern 100 is formed on the conveying belt 10 so that the patch length L is 1.8 mm, and the patch formation period T is 8 mm. The ratio of the peripheral speed of the cleaning roller 22 to the moving speed of the conveying belt 10 is controlled by the CPU 51 so as to be 1.57. At this time, the value of R/V is 30.0.

When the conditions are substituted into Exp. (1), the following expression is attained:

$$(8\times N+1.8)/n\leq 30.0\leq(8\times(N+1)-1.8)/n \qquad \text{Exp. (5)}$$

In the case of n=1, 2, or 3, when N=3, 7, or 11 is substituted, Exp. (5) is satisfied.

Specifically, in the case of n=1, when N=3, the expression is indicated as 25.8≤30.0≤30.2, in the case of n=2, when N=7, the expression is indicated as 28.9≤30.0≤31.1, and, in the case of n=3, when N=11, the expression is indicated as 29.9≤30.0≤31.4.

In the case of n=4, when N=14, the left side of Exp. (5) is 29.55, and, when N=15, the right side is 30.45. Therefore, there is no value of N which satisfies Exp. (7) in the case of n=4. This is seen also from that T/L=4.44 and, in the case of n=4, n+1<T/L is not satisfied. Consequently, the cleaning roller 22 attracts, during the fifth rotation, the patch Q for the first time in the place which overlaps with that where the patch Q is first attracted.

Namely, the maximum value of n which satisfies Exp. (5) is 3, and hence it is possible to prevent, during the (n+1)-th rotation, i.e., the fourth rotation of the cleaning roller 22, the patches Q from being attracted in a place which overlaps with the first patch Q.

MODIFICATION

Next, a modification will be described with reference to FIG. 9. In the modification, the CPU 51 forms patches S which are density correction images, in addition to the patches Q.

Figure 9:
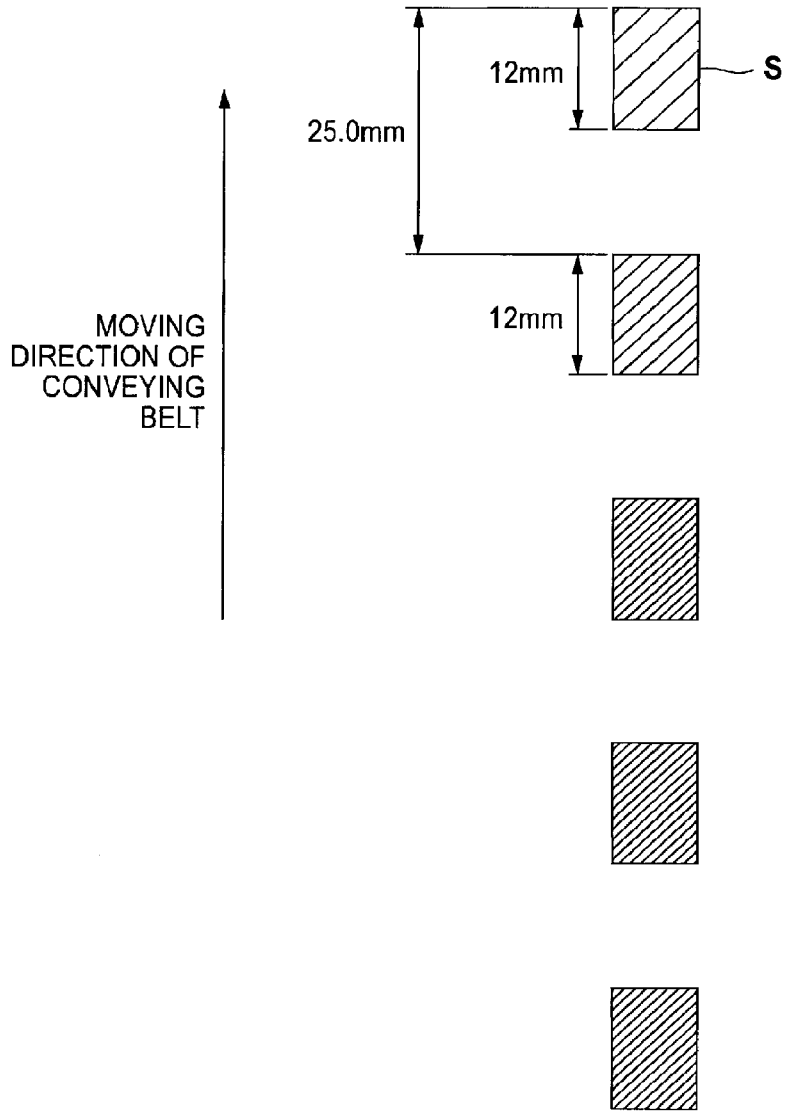
FIG. 9 is a view showing density correction patches.

FIG. 9 shows a plurality of density correction patches S which are formed on the conveying belt 10 in a predetermined patch length L and a predetermined patch formation period T. The CPU 51 forms a plurality of patches S of different densities for each of the colors by using a well-known method. In FIG. 9, patches S of five gray scales are formed, and the densities of the patches S are made higher as further advancing from the upper side of the sheet surface to the lower side.

In accordance with a result of the detection of the patches S by the optical sensor 17, the CPU 51 then corrects the developing bias to be applied to the developing roller 7, and the transferring bias to be applied to the transfer roller 13.

As shown in FIG. 9, the patch length L of the patches S is 12 mm, and the patch formation period T is 25 mm. As described above, the patches S are different from the patches Q in values of the patch length L and the patch formation period T.

Therefore, the CPU 51 which functions as a changing unit changes the ratio V of the peripheral speed of the cleaning roller 22 to the moving speed of the conveying belt 10, in the formation of the patches S from that in the formation of the patches Q. Consequently, the cleaning roller 22 can efficiently remove the patches Q and the patches S from the conveying belt 10.

For example, the CPU 51 forms the patches Q under the conditions shown in FIG. 7. Namely, the patch length L is 1.8 mm, and the patch formation period T is 4.0 mm.

Then, the CPU 51 controls the peripheral speeds the conveying belt 10 and the cleaning roller 22 so that the ratio of the peripheral speed of the cleaning roller 22 to the moving speed of the conveying belt 10 is 1.57. When the conditions are substituted into Exp. (1), the resulting expression is identical with Exp (4).

By contrast, the CPU 51 forms the patches S under the conditions shown in FIG. 9, at a timing different from that when the patches Q are formed. At this time, the CPU 51 controls the peripheral speeds of the conveying belt 10 and the cleaning roller 22 so that the ratio of the peripheral speed of the cleaning roller 22 to the moving speed of the conveying belt 10 is 1.26. Under the conditions, Exp. (1) is as follows:

$$(25\times N+12)/n\leq 37.5\leq(25\times(N+1)-12)/n \qquad \text{Exp. (6)}$$

In the case of n=1, when N=1, Exp. (1) is indicated as 37≤37.5≤38. There is a value of N which satisfies the above. In the case of n=2, there is no value of N which satisfies Exp. (6). During the third rotation, therefore, the cleaning roller 22 attracts the patch S in the place which overlaps with that where the patch S is adhered during the first rotation.

By contrast, in the case where the patches S are removed while the value of the ratio V of the peripheral speed of the cleaning roller 22 to the moving speed of the conveying belt 10 is set to 1.26, i.e., R/V=30.0, Exp. (1) is as follows:

$$(25\times N+12)/n\leq 30.0\leq(25\times(N+1)-12)/n \qquad \text{Exp. (7)}$$

However, n and N which satisfy the above do not exist.

As described above, in accordance with the patch lengths L and patch formation periods T of the formed patches Q, S, the CPU 51 changes the ratio V of the peripheral speed of the cleaning roller 22 to the moving speed of the conveying belt 10, whereby the patches Q, S on the conveying belt 10 can be satisfactorily removed.

In the embodiment, the patches Q, S are formed on the conveying belt 10. Depending on the configuration of the image forming apparatus, the patches Q, S may be formed on a photosensitive drum or an intermediate transfer belt (or an intermediate transfer member), and detected by an optical sensor or the like.

The surface of the cleaning roller 22 may be formed by a brush.

What is claimed is:

1. An image forming apparatus comprising:

an image carrier configured to rotate in a predetermined direction;

a correction image forming unit configured to form a plurality of correction images for correcting image forming conditions, on the image carrier in the predetermined direction; and a cleaning roller configured to clean the correction images on the image carrier, and wherein, with respect to all values ranging from 1 to an arbitrary value n, a positive integer N which satisfies the following expression for each value of n exists:

$$(T\times N+L)/n\leq R/V\leq(T\times(N+1)-L)/n$$

where R represents a circumferential length of the cleaning roller, L represents a length of each of the correction images in a moving direction of the image carrier, T represents a formation interval of the correction images in the moving direction of the image carrier, V represents a ratio of a peripheral speed of the cleaning roller to a moving speed of the image carrier, and n is a positive integer.

2. The image forming apparatus according to claim 1 further comprising a secondary cleaning member which is placed in contact with the cleaning roller, and which is configured to clean a surface of the cleaning roller.

3. The image forming apparatus according to claim 2, wherein n has a value of 1.

4. The image forming apparatus according to claim 2, wherein n has a value of 2.

5. The image forming apparatus according to claim 2, wherein n has a value of 3.

6. The image forming apparatus according to claim 1 further comprising a changing unit configured to change the ratio V, the correction image forming unit forms position correction images for correcting image forming positions of respective colors with respect to a recording medium, and density correction images for correcting a density of an image formed on the recording medium, the position correction images being different from the density correction images in the correction image length L and the correction image formation period T, and the changing unit changes a value of the ratio V if the position correction images are formed, from the value when the density correction images are formed.

* * * * *